US005971703A

United States Patent [19]

Bouchard

[11] Patent Number: 5,971,703

[45] Date of Patent: Oct. 26, 1999

[54] SEAL ASSEMBLY FOR A GAS TURBINE ENGINE

[75] Inventor: Guy Bouchard, Mont St. Hilaire, Canada

[73] Assignee: Pratt & Whitney Canada Inc., Longueuil, Canada

[21] Appl. No.: 08/986,000

[22] Filed: Dec. 5, 1997

[51] Int. Cl.[6] ..... F01D 11/08

[52] U.S. Cl. ..... 415/135; 415/139; 415/173.1; 415/173.3

[58] Field of Search ..... 415/115, 135, 415/138, 139, 170.1, 173.1, 173.3, 174.2; 277/579, 580, 643, 931

[56] References Cited

U.S. PATENT DOCUMENTS

| | | | |
|---|---|---|---|
| 3,836,279 | 9/1974 | Lee . | |
| 3,853,336 | 12/1974 | Shank . | |
| 4,242,042 | 12/1980 | Schwarz . | |
| 4,465,284 | 8/1984 | Szema | 277/931 |
| 4,573,866 | 3/1986 | Sandy, Jr. et al. . | |
| 4,635,332 | 1/1987 | Cederwall et al. . | |
| 4,749,333 | 6/1988 | Bonner et al. . | |
| 5,137,421 | 8/1992 | Hayton . | |
| 5,154,577 | 10/1992 | Kellock et al. | 415/170.1 |
| 5,161,944 | 11/1992 | Wood . | |
| 5,188,506 | 2/1993 | Creevy et al. . | |
| 5,192,185 | 3/1993 | Leonard . | |
| 5,197,853 | 3/1993 | Creevy et al. . | |
| 5,226,787 | 7/1993 | Freeman | 415/170.1 |
| 5,232,340 | 8/1993 | Morgan . | |
| 5,320,486 | 6/1994 | Walker et al. . | |
| 5,338,152 | 8/1994 | Feldmann . | |
| 5,407,319 | 4/1995 | Harrogate et al. . | |
| 5,553,999 | 9/1996 | Proctor et al. . | |
| 5,655,876 | 8/1997 | Rock | 415/139 |

*Primary Examiner*—Christopher Verdier
*Attorney, Agent, or Firm*—Jeffrey W. Astle

[57] ABSTRACT

An assembly for improving the operation of a gas turbine engine having an annular turbine support case and a plurality of shroud segments supported on the inner, radial side of the turbine support case. The shroud segments are located end-to-end to form an annular shroud within the turbine support case. Slots are provided in each of the adjacent ends of adjacent shroud segments, and seals are provided for insertion in the slots for sealing the gaps between the adjacent ends of adjacent shroud segments. The seals further include extensions which cooperate with the turbine support case to prevent rotation of the shroud segments relative to the turbine support case.

15 Claims, 3 Drawing Sheets

SEAL ASSEMBLY FOR A GAS TURBINE ENGINE

BACKGROUND OF THE INVENTION

1. Field of the Invention

This invention is directed toward an improved assembly for use in a gas turbine engine. The invention is more particularly directed toward an improved seal assembly in the shroud arrangement in a gas turbine engine. The invention is also directed toward an improved seal for use in the assembly.

2. Description of the Prior Art

The tips of the blades in a rotor in a gas turbine engine are surrounded by an annular shroud. The shroud is usually made in segments of an annulus which are placed in end-to-end relationship to circumscribe the rotor. The segments are supported from an outer, annular, turbine support case. The shroud segments have slight gaps between them to allow for expansion during operation. Cooling air is introduced into an annular space formed between the turbine support case and the shroud segments to cool the shroud segments. The cooling air can, however, leak radially inwardly from the annular space between the expansion gaps and can also leak axially downstream between the expansion gaps and from between the downstream connection between the shroud segments and the turbine support case. It is normal to provide seals between the shroud segments and turbine support case that minimize leakage of the cooling air both radially and axially.

SUMMARY OF THE INVENTION

It is the purpose of the present invention to provide a relatively simple and inexpensive seal assembly which provides both sealing of the shroud segments in both the radial and axial directions and which at the same time prevents rotation of the shroud segments relative to the turbine support case.

The seal assembly includes a seal strip that has an L-shape with the long leg of the seal strip adapted to be mounted axially in slots in adjacent ends of adjacent shroud segments to provide sealing in the radial direction and with the short leg of the strip simultaneously extending radially adjacent the downstream side of the shroud segments providing sealing in the axial direction from the gap. At the same time, stop means, provided on the short leg, extend into a radial notch formed in the casing opposite the gaps. The stop means, within the notch, prevents the shroud segments from rotating relative to the casing. Preferably the stop means comprise an extension of the short leg.

The invention is particularly directed toward an assembly for improving the operation of a gas turbine engine having an annular turbine support case and a plurality of shroud segments supported radially inwardly of the support case. The shroud segments are located end-to-end to form an annular shroud within the support case. Seal receiving means are provided in each of the adjacent ends of adjacent shroud segments. A seal is provided for insertion in the seal receiving means for sealing the gaps between the adjacent ends of adjacent shroud segments in both a radial direction and an axial direction. Cooperating rotation prevention means are also provided on the seal and the support case on its downstream side for preventing rotation of the shroud segments relative to the support case.

The invention is further directed toward a seal for use in an assembly in a gas turbine engine having an annular turbine support case and a plurality of shroud segments supported within the support case. The shroud segments are located end-to-end to form an annular shroud within the support case. The seal comprises an L-shaped strip having a long leg for insertion in a slot receiving means in adjacent ends of adjacent shroud segments to seal the gap between the ends of the segments in a radial direction and a short leg, extending transverse to the long leg, for sealing the gap between the ends in an axial direction. The seal also has rotation preventing means on its short leg adapted to cooperate with means on the support case for preventing circumferential movement of the shroud segments when the seal is mounted on the shroud segments.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
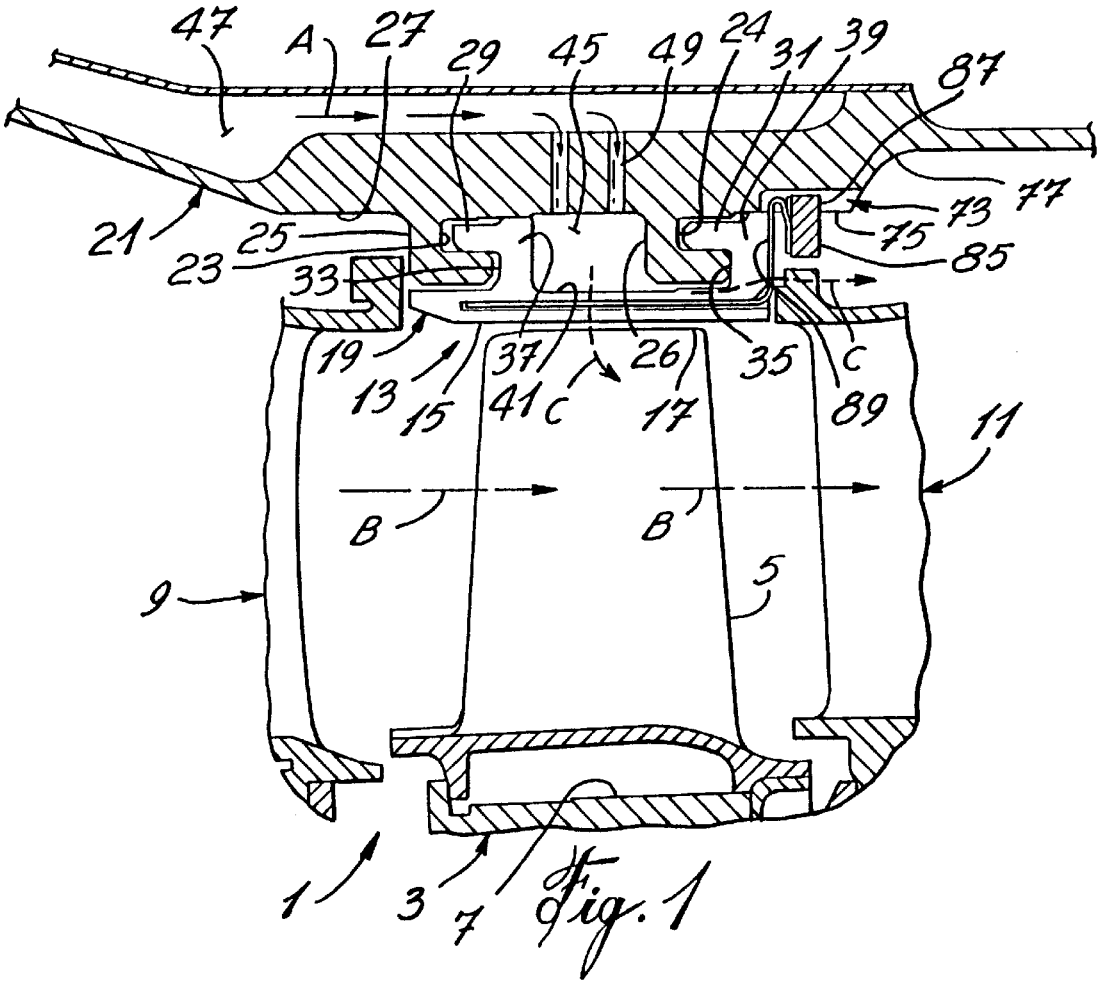
FIG. 1 is a fragmentary, axial cross-section of the turbine section with the improved seal assembly.
Figure 2:
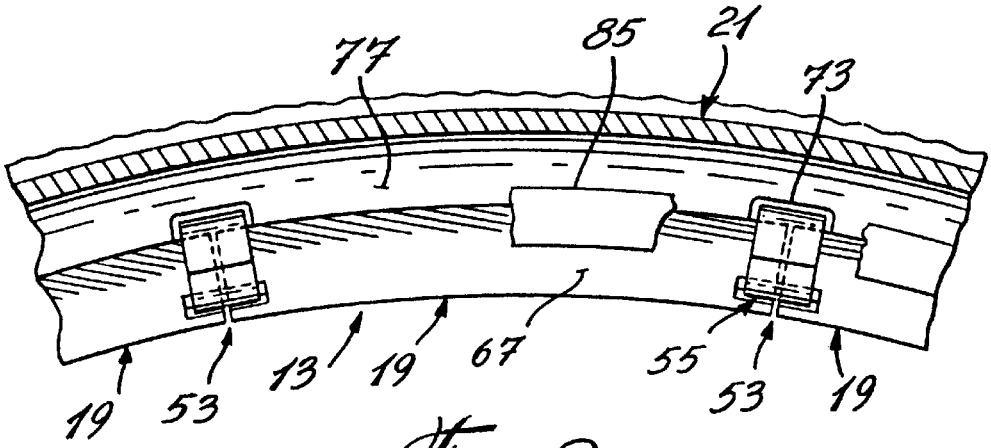
FIG. 2 is a fragmentary, axial elevation, partly in cross-section, of the seal assembly in the shroud.

The gas turbine engine 1, as shown in FIGS. 1 and 2, has a rotor 3 carrying radially extending rotor blades 5 on its outer rim 7. The rotor 3 is located between adjacent stators 9 and 11. An annular shroud 13 surrounds the rotor 3, its inner radial surface 15 located closely adjacent to the tips 17 of the rotor blades 5.

The annular shroud 13 is made up of shroud segments 19 that are located end-to-end to form an annulus. The shroud segments 19 are mounted within a support case 21 that surrounds the rotor 3. Cooperating mounting means are provided on both the shroud segments 19 and the support case 21 for mounting the shroud segments 19 within the case 21.

These mounting means, on the case 21, can comprise an annular upstream slot 23 and an annular downstream slot 24, axially spaced from the upstream slot 23, forming ribs 25, 26 on the inner face 27 of the case 21. Both axial slots 23, 24 open up in the downstream direction. The cooperating mounting means on each shroud segment 19 can comprise flanges 29, 31 projecting upstream from the upstream faces 33, 35 of spaced-apart raised ribs 37, 39 on the outer surface 41 of the shroud segment 19. The flanges 29, 31 on the shroud segments 19 fit within the slots 23, 24 on the case 21 to mount the shroud segments 19.

An annular chamber 45 is formed between the shroud segments 19 and the turbine support case 21, between the ribs 37, 39 on the shroud segments 19 into which cooling air, as shown by the arrows A, can be directed from a cooling channel 47 formed outside the case 21. The cooling air passes from the cooling channel 47 to the annular cooling chamber 45 through radial openings 49 formed in the case 21.

The cooling air cools the shroud segments 19 from the hot gases passing through the hot gas path shown by the arrows B. This cooling air can, however, leak from the annular chamber 45 in both a radial, inward direction and an axial, downstream direction, as shown by the arrows C, through gaps 53 formed between the shroud segments 19. These gaps 53 are provided to accommodate expansion of the shroud segments 19 during operation of the turbine.

Figure 3:
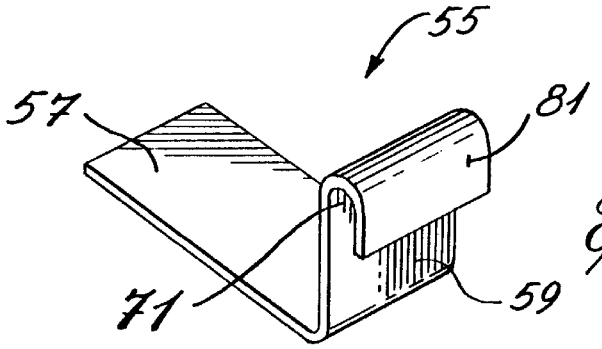
FIG. 3 is a perspective view of the seal element.
Figure 4:
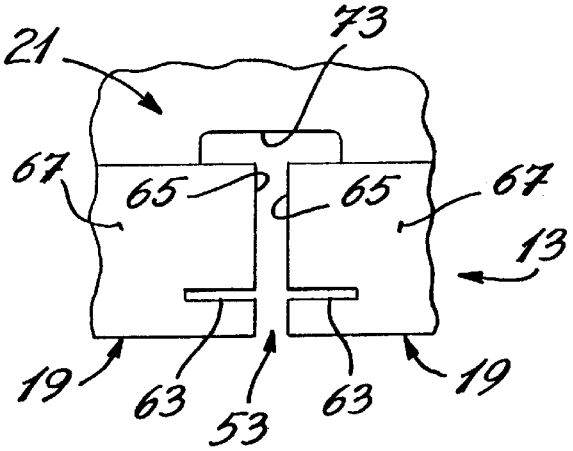
FIG. 4 is an enlarged axial elevation of a detail of the present invention but with the seal element removed.

To minimize the leakage, it is known to provide seals in the shroud assembly to seal the gaps 53 between the shroud segments 19. In the present invention, a seal 55 is provided made from a strip of suitable sheet material that is bent in an L-shape, as shown in FIG. 3, to provide a long leg 57 and a short leg 59 at one end of the long leg 57 and extending at right angles to the long leg. The shroud elements 19 are each provided with a slot 63 at each end 65 of the element, as shown in FIG. 4. The slot 63 at each end extends inwardly in an axial direction from the downstream side 67 of the segment. The slot 63 also extends inwardly from the end 65 in a circumferential direction. The slot 63 is slightly longer in the axial direction from the side 67 than the length of the long leg 57 of the seal 55 and has a width slightly more than half the width of the long leg 57 in the circumferential direction from the end 65.

Figure 5:
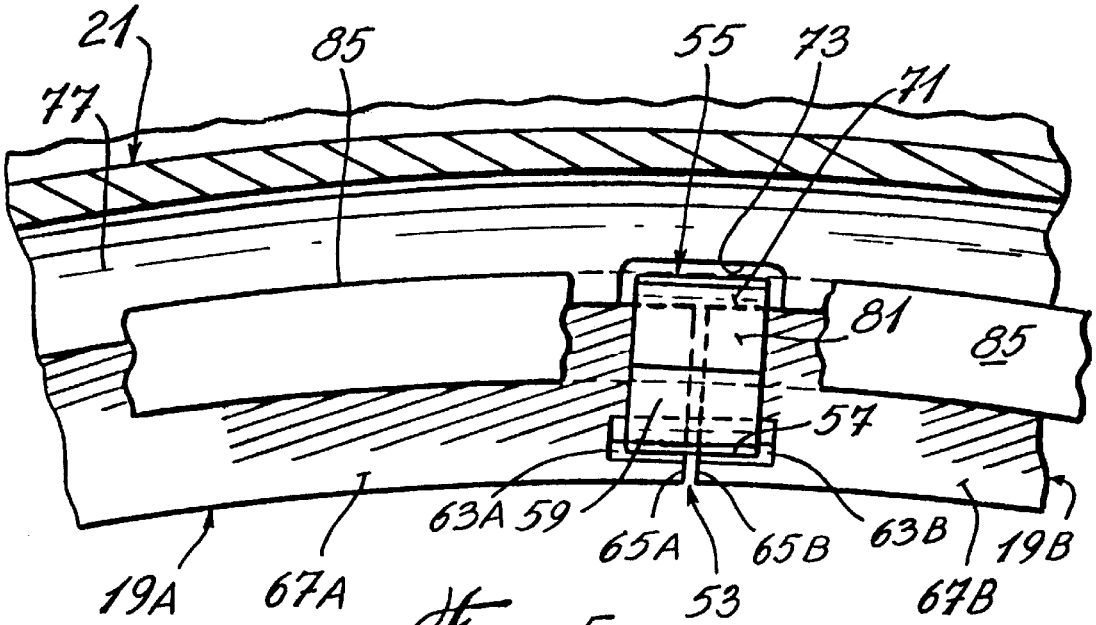
FIG. 5 is an enlarged axial view similar to FIG. 2.

The seal is mounted by inserting its long leg 57 into adjacent slots 63A, 63B in adjacent ends 65A, 65B of adjacent shroud segments 19A, 19B, as shown in FIG. 5. The long leg 57 seals the gap 53 between the shroud segments 19A, 19B in the radial, inward direction and the short leg 59, against the downstream sides 67A, 67B of the shroud segments 19A, 19B, seals the gap 53 in the axial, downstream direction.

In accordance with the present invention, the seal 55 and the turbine support case 21 are provided with cooperating rotation preventing means for preventing the shroud segments 19 from moving circumferentially relative to the case 21. The rotation preventing means on the seal 55 can comprise an extension 71 of the short leg 59 of the seal 55 so that the short leg is slightly longer than the thickness of the shroud segments 19. The cooperating rotation preventing means on the case 21 can comprise a notch 73, radially aligned with the adjacent slots and extending radially outwardly, a short distance from the inner face 75 of the turbine support case 21 and axially upstream and radially inward from the downstream face 77 of the support member 21 just past the downstream face 89 of the shroud segments 19, as shown in FIG. 1.

When the seal 55 is mounted in the slots 63A, 63B, the extension 71 on the short leg 59 projects up into the notch 73 formed in the turbine support case 21 and prevents the shroud segments 19 from rotating relative to the turbine support case 21.

Preferably, the seal 55 has an outer spring leg section 81 formed integrally with the short leg 59 and its integral extension 71, the outer leg section 81 located close to the short leg 59, parallel to it, but not as long (FIG. 5). The short leg 59, the extension 71, and the outer spring leg 81 are all formed integrally, in series, from a single piece of material. A split ring retainer 85 is mounted adjacent the outer leg 81 in a groove 87 in the inside surface 27 of the turbine support case 21 to retain the seal 55 in place. The ring 85 biases the outer leg 81 axially in an upstream direction to press the short leg 59 tight against the downstream face 89 of the shroud segments 19.

Figure 6:
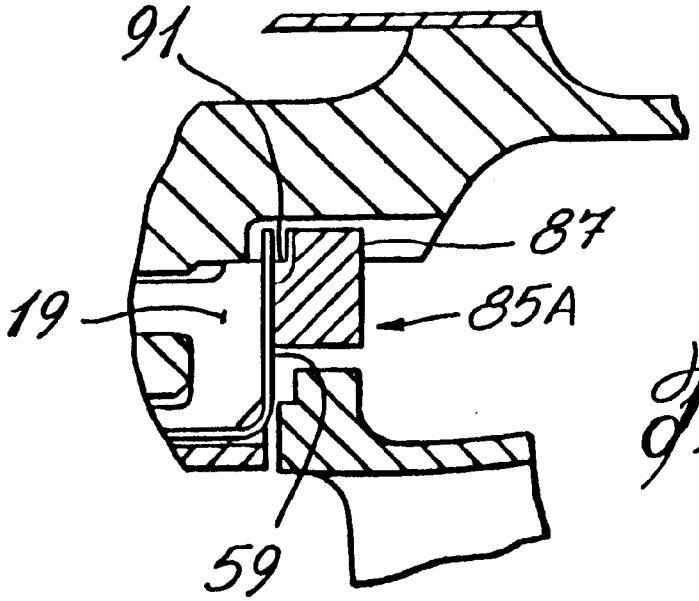
FIG. 6 is a detail view of the downstream end of the seal assembly showing a variation in the assembly.

The seal 55 can be formed without the outer spring leg section 81. Instead, biasing means to bias the short leg 59 of the seal 55 against the shroud segments 19 can be provided by a modified split ring 85A. As shown in FIG. 6, the split ring 85A can be provided with a shoulder 91 extending axially upstream, the shoulder 91 dimensioned to bear tightly against the short leg 59, pushing it tight against the shroud segments 19 to close the gap 53 in the axial direction when the ring 85A is mounted in the groove 87 in the case 21.

Figure 7:
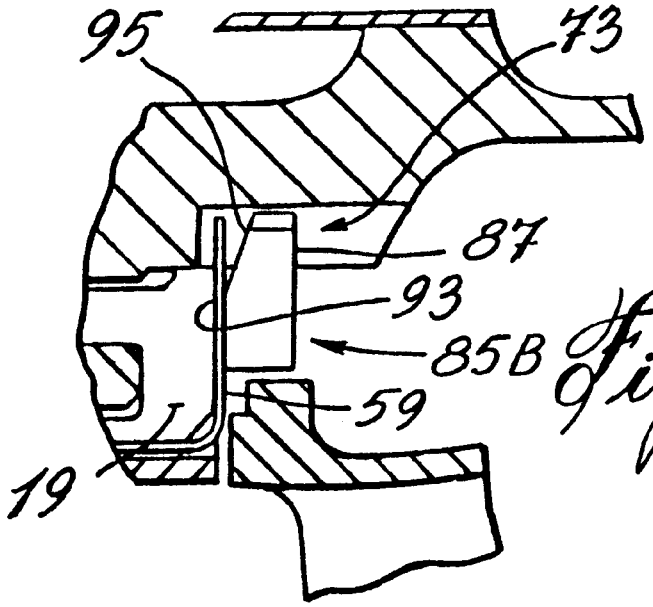
FIG. 7 is a detail view of the downstream end of the seal assembly showing another variation in the assembly.

Alternatively, without the outer spring leg section, the biasing means can comprise, as shown in FIG. 7, a split ring 85B having an inner face 93 which pushes tightly against the short leg 59 to seal the gap. The outer radial portion 95 of the inner face 93 tapers away from the short leg 59.

While one form of cooperating non-rotating means has been shown, other forms of non-rotating means can be used. For example, the short leg could be provided with an outwardly projecting tab, much narrower than the short leg, which fits in a narrow notch formed in the turbine support case.

I claim:

1. A sealing member for sealing gaps in shroud elements supported by a support case in a gas turbine engine, the member made from a strip of sheet material bent to form a long leg, and a short leg, extending transversely from one end of the long leg the short leg including an extension arranged to engage the support case to prevent rotation of the shroud elements.

2. A sealing member as claimed in claim 1, wherein the extension projects outwardly from the short leg.

3. A sealing member as claimed in claim 1, wherein the extension extends in the same direction as the short leg.

4. A sealing member as claimed in claim 1, including a spring leg bent back from the free end of the short leg to overlie the short leg and to be spaced from the short leg.

5. A sealing member as claimed in claim 2, including a spring leg bent back from the free end of the short leg to overlie the short leg and be spaced from the short leg.

6. A sealing member as claimed in claim 3, including a spring leg bent back from the free end of the extension to overlie the short leg and to be spaced from the short leg.

7. An assembly for improving the operation of a gas turbine engine having an annular turbine support case and a plurality of shroud segments supported on the inner, radial side of the support case, the shroud segments located end-to-end to form an annular shroud within the support case; seal receiving means in each of the adjacent ends of adjacent shroud segments; a seal for insertion in the seal receiving means for sealing the gaps between the adjacent ends of adjacent shroud segments in both an inner, radial direction and a downstream, axial direction; and cooperating rotation prevention means on the sealing means and the support case, on its downstream side, for preventing rotation of the shroud segments relative to the support case.

8. As assembly as claimed in claim 7, wherein the seal comprises an L-shaped sealing strip having: a long leg for insertion in adjacent slots in adjacent ends of adjacent shroud segments to seal the gap between the segments in the inner radial direction; and a short leg transverse to the long leg for positioning adjacent the downstream side of the shroud segments adjacent the gap to seal the gap between the segments in the downstream, axial direction.

9. An assembly as claimed in claim 8, wherein the cooperating rotation prevention means comprises an extension on the free end of the short leg of the sealing strip extending radially outwardly past the shroud segments when the sealing strip is mounted in the slots in the ends of the shroud segments; and a radially outwardly directed notch in the inner side of the support case for receiving the extension.

10. An assembly as claimed in claim 8, wherein the short leg of the sealing strip has a spring leg extending therefrom; and a retaining ring mounted in the inner side of the support case and adjacent the spring leg for biasing the spring leg, and thus the short leg, against the downstream side of the shroud segments to better seal the gap.

11. An assembly as claimed in claim 9, wherein the short leg of the sealing strip has a spring leg extending from the extension thereon and located adjacent to the short leg; and a retaining ring mounted in the support case and adjacent the spring leg for biasing the spring leg, and thus the short leg, against the downstream side of the shroud segments to better seal the gap.

12. An assembly as claimed in claim 8, including a retaining ring mounted in the inner side of the support case and located adjacent the downstream side of the short leg of the sealing strip, the retaining ring having a shoulder to bear against the short leg to hold the short leg tight against the downstream face of the shroud segments.

13. An assembly as claimed in claim 9, including a retaining ring mounted in the inner side of the support case and located adjacent the downstream side of the short leg of the sealing strip, the retaining ring having a shoulder to bear against the short leg to hold the short leg tight against the downstream face of the shroud segments.

14. An assembly as claimed in claim 8, including a retaining ring mounted in the inner side of the support case, the inner upstream face of the retaining ring located against the downstream side of the short leg of the sealing strip, the outer radial portion of the inner face tapering away from the short leg in the radial outward direction.

15. An assembly as claimed in claim 9, including a retaining ring mounted in the inner side of the support case, the inner upstream face of the retaining ring located against the downstream side of the short leg of the sealing strip, the outer radial portion of the inner face tapering away from the short leg in the radial direction.

* * * * *